252-99 AU 165 EX
11/15/77 XR 4,058,472

United States Patent [19]
Kablaoui

[11] 4,058,472
[45] Nov. 15, 1977

[54] DETERGENT COMPOSITION

[75] Inventor: Mahmoud S. Kablaoui, Wappingers Falls, N.Y.

[73] Assignee: Texaco Inc., New York, N.Y.

[21] Appl. No.: 700,623

[22] Filed: June 28, 1976

[51] Int. Cl.[2] ..... C11D 3/395
[52] U.S. Cl. ..... 252/89 B; 252/95; 252/99; 252/121; 252/539; 252/558; 260/505 A
[58] Field of Search ..... 252/539, 558, 89 B, 252/95, 99, 109, 121, 135; 260/505 A

[56] References Cited

U.S. PATENT DOCUMENTS

| | | | |
|---|---|---|---|
| 3,758,420 | 9/1973 | Conner et al. | 252/558 X |
| 3,812,044 | 5/1974 | Conner et al. | 252/558 X |
| 3,816,353 | 6/1974 | Sharman et al. | 252/558 |
| 3,864,286 | 2/1975 | Anderson | 252/558 X |

*Primary Examiner*—Thomas J. Herbert, Jr.
*Assistant Examiner*—Bruce H. Hess
*Attorney, Agent, or Firm*—Thomas H. Whaley; Carl G. Ries; James F. Young

[57] ABSTRACT

A detergent composition containing as the surface active component the alkali metal or ammonium salts of a sulfonated $C_{14}$–$C_{18}$ alkyl catechol admixture.

4 Claims, No Drawings

DETERGENT COMPOSITION

The present invention is directed to novel detergent compositions containing the alkali metal and ammonium salts of sulfonated $C_{14}$–$C_{18}$ alkylcatechols as the surfactant component thereof.

It is known that long straight chain alkyl benzene sulfonates have been used as surfactants in detergent compositions heretofore.

It has now been found that the novel detergent compositions of the present invention containing a specific surfactant component therein wherey improved detergency is obtained.

The terms "surfactant" or "surface-active", which are used throughout this disclosure, are synonymous and refer to substances which, in solution, are used by themselves or in conjunction with cleaning adjuvants such as additives or builders to form detergent cleaning compositions. These detergent compositions are widely used as aqueous solutions to wet surfaces, remove soil, penetrate porous materials, disperse particles, emulsify oils and greases, etc., dependent upon the particular characteristics of the composition and the components thereof.

The surfactant component thereof is a material or materials which is effective at low concentration levels in aqueous solutions and which can be produced in good yield from readily available low cost starting materials, is free from deleterious contaminants, is preferably easily handled, and are free-flowing liquids or powders.

For many applications such as heavy duty industrial applications for metal scouring and dishwasher detergent compositions, the compositions necessarily include highly alkaline materials such as alkali metal hydroxides, alkoxides and phosphates. In the aqueous media that the detergent composition functions, the pH frequently will be from 10 to 13. For this reason a prerequiste of heavy duty industrial detergent compositions is its stability at elevated pH's in aqueous solutions.

The detergent compositions of the present invention contain as the surfactant component from about 0.01 to about 10% by weight of the alkali metal or ammonium salts of sulfonated $C_{14}$–$C_{18}$ alkyl catechols including mixtures thereof, from about 80 to about 40% by weight of a water soluble inorganic builder material or builder materials, that is normally one or more of known inorganic salts, acids and/or bases, such as the alkalis, phosphates and silicates of the alkali metals including ammonium or the corresponding neutral salts of mixtures thereof. The composition may also contain from about 0 to about 15 to 20% by weight of organic builder material or materials that impart to the composition foaming power and/or emulsifying power, or have a soil-suspending function in the composition. Suitable organic builder materials include sodium carboxymethylcellulose, ethylenediamine-tetraacetic acid and fatty monoethanolamides and the like.

The detergent composition may further contain relatively minor amounts, on the order of from about 0.5 to about 5% by weight of special purpose components such as one or more of the lower alkanols, glycols, ethers that function as solubilizing agents, as well as known bleaching agents or brighteners which are dyestuffs that do not absorb or reflect light in the visible range of the spectrum. The surfactant component of the detergent composition is an alkali metal or ammonium salt or salts of a sulfonated $C_{14}$–$C_{18}$ alkylcatechol or mixed sulfonated $C_{14}$–$C_{18}$ alkylcatechols.

The catechol is present in the admixture in a weight ratio of from about 50 to 70 parts of mono ($C_{14}$ – $C_{18}$) alkyl catechol and from about 50 to 30 parts of di ($C_{14}$ – $C_{18}$) alkyl catechol.

The surfactant component is prepared in the following manner:

EXAMPLE I

A hexadecylcatechol mixture was obtained by reaction of one mole of 1-hexadecene with two moles of catechol in the presence of 10% by weight of "Amberlyst 15", (a sulfonic acid cation exchange resin having a macroreticular structure and being obtained from Rhom & Haas,) as a catalyst and consisted essentially of about 70% mono-hexadecyl catechol and about 30% of di-hexadecyl catechol, by analysis.

This admixture in an amount of 19.7 grams was added slowly to 75 grams of concentrated sulfuric acid to keep the temperature below 20 C. The reaction mixture was then heated to 90° C. for 5 minutes while maintaining the reactants under a nitrogen atmosphere. The resulting reaction solution was then cooled to 10° C., and 25 ml. of water followed by a solution of 60 grams of sodium hydroxide in 150 ml. water were added slowly so as to keep the temperature below 30° C. The reaction mixture was then stripped to dryness on a rotatory evaporator under vacuum. The solids thus formed were extracted four times using per extraction, 150 ml. of ethanol, the ethanol stripped and the product extracted once with methanol. Analysis of the solids confirmed the product was the sodium salt.

EXAMPLE II

Another portion of the same hexadecylcatechol mixture as used in Example I above was sulfonated at 70° C. for 5 minutes as in Example 1, above. The sulfonated catechol mixture was added slowly to a solution of 9.0 g. of sodium metal in 250 ml. of ethanol so as to keep the temperature between 10°–20° C. The resulting reaction solution was then filtered and the ethanol stripped therefrom. The product was identified as the sodium salt of sulfonated hexadecycatechol.

The effectiveness of each of the above prepared surfactants was determined in the following tests carried out in a laboratory Launder-Ometer.

The procedure used was to immerse sized swatches of standard soiled cotton cloth in 200 ml. of an aqueous wash solution containing 0.1 and 0.2% by weight of the surfactant for 10 minutes while maintaining the solution at 60° C. Duplicate runs were made at each concentration range and builder materials were also present in some tests. For purposes of comparison similar tests were carried out on commercial detergents.

The wash solutions were prepared from distilled water and had been treated to provide a water hardness of 3165 ppm as calcium carbonate (185 grains).

The washed cloth swatches were removed from the test solution containers, rinsed, dried and the relative degree of whiteness measured using a Photovolt Reflectometer in accordance with known practice.

The data obtained with the Reflectometer were recorded and averaged for the two runs at each concentration to obtain an average Reflectance for the washed cloth. This value was converted to an "Average Detergency Coefficient", (ADC) value, determined by expressing the soil removal properties of each of the test compositions as a percentage of the results with a known standard detergent composition.

The test results (ADC) are set forth in the following Table together with additional particulars, if applicable, to the compositions of the wash solutions.

TEST RESULTS

| Example | Additive | Additional Additive | Detergent/Builder Ratio | ADC |
|---|---|---|---|---|
| 3. | Product of Ex I | — | — | 134 |
| Comparative Ex. A | Commercial sodium salt of $C_{14}$—$C_{18}$ olefin sulfonate | — | — | 100 |
| 4. | Product of Ex I | — | — | 146 |
| Comparative Ex. B | Commercial linear alkylbenzene sulfonate | — | — | 100 |
| 5. | Product of Ex II | — | — | 183 |
| Comparative Ex. C | Commercial sodium salt of $C_{14}$—$C_{18}$ olefin sulfonate | — | — | 100 |
| 6. | Product of Ex II | Sodium tetra pyrophosphate builder | 30/70 | 129 |

In the above Table the test results obtained from runs made at separate times are reported. The grouping of the runs made at the same time is evident from the appearance of the table, the separation between each pair of Examples except for the last three, showing different run dates.

Comparison Examples A and C used the same sodium salt of a $C_{14}$–$C_{18}$ olefin sulfonate.

Inspection of the data show that the surfactant components of the detergent compositions are effective as detergents alone or in combination with inorganic builders. The data further show the degree of effectiveness of the materials in comparison with two types of commercial detergents.

Representative formulae for the compositions of the present invention are for Example, for Laundry Machine use, 0.01 – 10% of Example I or Example Ii surfactants, 20–40% by weight of sodium tetrapyrophosphate, 20–30% sodium silicate, 10–20% of sodium carbonate, 1–3% of sodium carboxymethylcellulose, and 0–10% of starch; for automatic dishwasher use, about 5–12% of the surfactant, about 10–40% sodium stearate and 55–78% sodium tetrapyrophosphate. The alkali metal and ammonium salts of the sulfonated $C_{14}$–$C_{18}$ alkyl catechols of the present invention can be prepared in a known manner such as by reacting a $C_{14}$–$C_{18}$ alkene with catechol in the presence of an alkylation catalyst to form a mixture of mono ($C_{14}$–$C_{18}$) alkyl catechol, and di ($C_{14}$–$C_{18}$) alkyl catechol, sulfonating said formed mixture with concentrated sulfuric acid, thereafter converting the sulfonated mixture to the alkali metal or ammonium salts by treatment with aqueous sodium or ammonium hydroxide or with sodium metal in ethanol.

I claim:

1. A detergent composition containing as the surface active component from about 0.01 to about 10% by weight of the alkali metal or ammonium salts of a sulfonated $C_{14}$–$C_{18}$ alkyl catechol admixture, said catechol being present in the admixture in a weight ratio of from about 50 to 70 parts of the mono ($C_{14}$–$C_{18}$) alkyl catechol and from about 50 to 30 parts of the di ($C_{14}$–$C_{18}$) alkyl catechol, from about 40 to about 80–90% of an inorganic builder material, from 0 to 20% of an organic builder material, and from about 0.5 to about 5% of a special purpose component, said special purpose component being at least one member selected from the group consisting of a solubilizing agent, a bleaching agent and a brightener.

2. A composition as claimed in claim 1 wherein said catechol is the sodium salt of sulfonated hexadecyl catechol.

3. A laundry machine detergent composition consisting essentially of from about 0.01 to 10% by weight of the sodium salts of sulfonated $C_{14}$–$C_{18}$ alkyl catechol as the surface active component, said catechol being composed of a mixture of 50 to 70 parts by weight of mono ($C_{14}$–$C_{18}$) alkyl catechol and from 50 to 30 parts by weight of di ($C_{14}$–$C_{18}$) alkyl catechol, from about 20 to 40% of sodium tetrapyrophosphate, from about 20 to 30% of sodium silicate, from about 10 to 20% of sodium carbonate, from about 1 to 3% of sodium carboxymethylcellulose and 0 to 10% of starch.

4. A automatic dishwasher detergent composition consisting essentially of from about 0.01 to 12% by weight of the sodium salts of sulfonated $C_{14}$–$C_{18}$ alkyl catechol, from about 10 to 40% sodium stearate and from about 55 to 78% of sodium tetrapyrophosphate, said catechol being composed of a mixture of 50 to 70 parts by weight of mono ($C_{14}$–$C_{18}$) alkyl catechol and from 50 to 30 parts by weight of di ($C_{14}$–$C_{18}$) alkyl catechol.

* * * * *